US005976633A

United States Patent [19]

Mosier

[11] Patent Number: 5,976,633

[45] Date of Patent: Nov. 2, 1999

[54] DIP COATING THROUGH ELEVATED RING

[75] Inventor: Scott Thomas Mosier, Boulder, Colo.

[73] Assignee: Lexmark International, Inc., Lexington, Ky.

[21] Appl. No.: 09/048,765

[22] Filed: Mar. 26, 1998

[51] Int. Cl.[6] ..... B05D 1/18; B05D 1/20

[52] U.S. Cl. ..... 427/430.1; 427/434.3

[58] Field of Search ..... 427/430.1, 434.3

[56] References Cited

U.S. PATENT DOCUMENTS

| | | | |
|---|---|---|---|
| 2,817,225 | 12/1957 | Weglin | 427/430.1 |
| 4,696,838 | 9/1987 | Miyata et al. | 427/407.2 |
| 4,783,348 | 11/1988 | Albrecht et al. | 427/402 |
| 5,120,627 | 6/1992 | Nozomi et al. | 430/59 |
| 5,147,553 | 9/1992 | Waite | 210/654 |
| 5,190,591 | 3/1993 | Okano et al. | 118/667 |
| 5,459,009 | 10/1995 | Fukuda et al. | 430/127 |
| 5,463,082 | 10/1995 | Horvath et al. | 549/46 |
| 5,624,716 | 4/1997 | Shulman | 427/430.1 |
| 5,626,998 | 5/1997 | Grabowski et al. | 430/67 |
| 5,683,742 | 11/1997 | Herbert et al. | 427/11 |

*Primary Examiner*—Shrive Beck
*Assistant Examiner*—Michael Barr
*Attorney, Agent, or Firm*—John A. Brady

[57] ABSTRACT

The bottom of a dip coating bath (5*a*) is perfluoro (methylcyclohexane), a dense, inert liquid. A much thinner layer of coating solution occupies the top (5*b*) of the bath. An aluminum drum (1) to be coated is moved into the bottom bath until the top of the drum is in the top of the bath. The drum is moved out of the bath and is coated by the top liquid. The amount of coating material used is greatly reduced and the inert liquid can be reused.

2 Claims, 1 Drawing Sheet

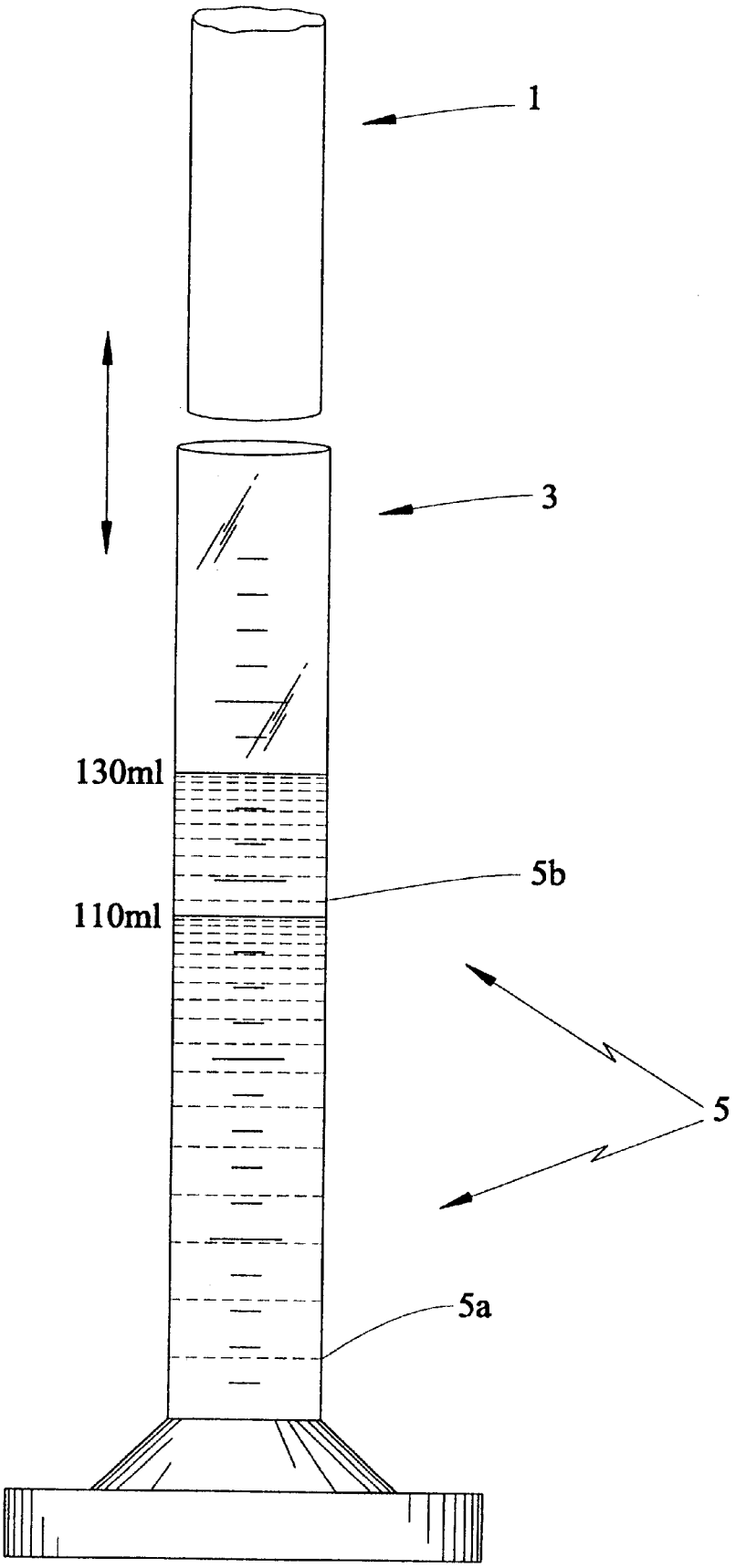
1
3
130ml
5b
110ml
5
5a

DIP COATING THROUGH ELEVATED RING

TECHNICAL FIELD

This invention relates to dip coating of regular elements such as roller, and, more specifically, to dip coating in a manner which minimizes waste of the coating material.

BACKGROUND OF THE INVENTION

Known dip coating is by immersing the item to be coated in a bath consisting entirely of the coating and moving the item out of the bath. A meniscus naturally forms between the bath and the item, and a coating of the bath material clings to the item. To coat, for example, a cylinder, the cylinder is oriented with its long axis vertically and is moved down into the bath and then upward out of the bath. As it leaves the bath, it is coated with the bath material.

Where the bath chemically deteriorates with the passage of time or by contamination from items immersed or the atmosphere, it is discarded and replaced by a new bath. This invention may employ standard coating apparatus but significantly limits the amount of bath material which is subject to such discharge. This invention employs a ring of coating material floating on a column of noncoating material. Example 1 of U.S. Pat. No. 5,683,742 to Herbert et al. has a film of coating material sprayed on water.

DISCLOSURE OF THE INVENTION

In accordance with this invention, a dense, inert liquid occupies the bottom area of the dip bath. This bottom area is recognized as an inactive or "dead space" which need not contain the material to be coated, termed here the coating solution. At least about 5 milliliters (ml) of a coating solution occupies the top area of the dip bath. The inert liquid is immiscible with the coating solution.

The junction of the inert liquid and the coating solution and the junction of the coating solution and the atmosphere define an active region where coating of a dipped item takes place. The presence of the inert liquid permits the item to be moved into the area occupied by the inert liquid, so that the upper part of the item can reach the active region.

The inert liquid need not be a material subject to deterioration and may be reused. The amount of coating material is greatly reduced from that which is used when the entire dip bath is the coating material.

A preferred application is to coat photoconductor drum with layers which have organic resin binders, the inert liquid being a perfluoroalkane and the coating material having organic solvents.

BRIEF DESCRIPTION OF THE DRAWING

The drawing illustrates a standard dip coating apparatus with the inert liquid and active region of this invention.

DESCRIPTION OF THE PREFERRED EMBODIMENTS

The drum 1 to be coated and thereby formed into a photoconductor is an empty aluminum cylinder with outer layer anodized, as is standard. The first coating on the drum is a charge generation layer (GCL), which is hardened by driving off its solvent. The second outer layer is a charge transport layer (GTL), which is dip coated over the drum 1 having the hardened charge generation layer and which is then also hardened by driving off its solvent. There may be a similarly applied barrier layer between drum 1 and the charge generation layer and there may be a similarly applied outer protective layer, although such an outer layer is not widely employed. Such layers typically employ a binding resin, which may be a wide variety of non-ionic organic resins such as polystyrenes, polyacrylic, polyester and mixtures thereof. One preferred binder resin for the charge generation layer is polyvinylbutyral, with a preferred binder resin for the charge transport layer being polycarbonate.

As shown in the drawing, a cylindrical vessel 3 contains a liquid bath 5 up to a level defining 130 milliliters (ML) of liquid. The lower region 5*a* of bath 5 is perfluoro (methylcyclohexane), and the upper region of bath 5, between 110 and 130 ML is a coating solution 5*b*, such as a dispersion to form a charge generation layer or a solution to form a charge transfer layer. The lower vertical column 5*a* thus has a thickness 5.5 times the thickness of the upper vertical column 5*b*.

A typical formula of bath 5*b* where it is to coat a charge generation layer is that it contains, by weight, about 6 parts oxotitanium phthalocyanine as photosensitive material, 8 parts polyvinyl butyral as a binder, 407 parts methyl ethyl ketone as a solvent and 45 parts cyclohexanone as a solvent.

When the foregoing polyvinyl butyral formula is the charge generation layer forming dispersion, a typical formula of bath 5*b* where it is to coat the charge transport layer is, by weight, about 346 parts N,N'-(3-methylphenyl)-N,N'-bis-(phenyl) benzidene as a charge transport material; 810 parts polycarbonate as a binder; 20,300 parts tetrahydrofuran as a solvent and 1,143 parts dioxane as a solvent.

The perfluoro(methylcyclohexane), in region 5*a* is immiscible with, and more dense than, the coating material in region 5*b*. When the two are mixed, the perfluoro (methylcyclohexane) immediately forms and a clear boundary forms between region 5*a* and region 5*b*.

Coating is effected by the standard technique of moving drum 1 vertically into vessel 3 until drum 1 is covered by coating material to the point at which coating is desired. (Typically, drum 1 is to be entirely coated, and drum 1 is lowered until its top is under the surface of region 5*b*.) The presence of a liquid in region 5*a* permits the drum 1 to be lowered to be at least partially under region 5*b*.

Drum 1 is then raised vertically, and final coating takes place where the surface of drum 1 leaves the coating material in region 5*b*. The coating is typically moved to hardness by heat to drive off the solvent. Any hardening or curing set appropriate to the coating mixture is equally suitable with respect to this invention.

A 30×254 mm anodized aluminum drum was dip coated with a charge generation forming dispersion in accordance with this invention followed by a 15 minute cure at 100° C. That drum was then dip coated with a charge transport forming solution in accordance with this invention followed by a one hour cure at 120° C. The two coatings were uniform layers. In each case, only 20 ML's of coating solution were needed with the remainder of the bath being 110 ML's of perfluoro(methylcyclohexane). After the coating was completed, the coating solution was decanted off and the perfluoro(methylcyclohexane) was collected for reuse.

The minimum amounts of charge generation and charge transport solution needed to coat a 30×254 mm photoconductor core were determined as follows: using this technique and coating out of a small graduated cylinder, an entire core can be coated with 6 ml of CGL dispersion and 15 ml of CTL solution. Previously, this coating would have required 130 ml of solution. In a laboratory where small amounts of material are often synthesized and purified, a full drum coating is now possible with 95% less CGL dispersion, and 88% less CTL solution. In the evaluation of a new charge transport molecule, this translates to the use of 1.9 grams of dopant to coat an entire core, vs. 12.1 grams (20% solids, 40% dopant) using the standard coating method.

The coating and other aspects except the method of coating as stated were otherwise the same as certain standard photoconductor drums. Comparison showed voltage vs. energy, voltage vs. dark decay, and thickness vs. distance from top of drum to be substantially the same.

The use of perfluoro(methylcyclohexane) to produce an elevated ring coater reduces the amount of coating solution needed to uniformly dip coat a photoconductor drum. This ability to obtain uniformly coated cores with a minimum of coating solution is especially important in the photoconductor development area where new compounds are often synthesized.

As the above illustrates, the net benefit of the solvent ring coater is the reduction of materials and labor necessary to formulate, coat, and dispose of large batches of coating solutions. This is of great importance in photoconductor development and has similar advantage in photoconductor manufacturing.

It will be apparent that this invention may be employed with a wide variety of coating materials and items coated.

I claim:

1. The process of coating the surface of an item comprising moving said item down in a bath comprising at least about 5 ml of a first liquid which will coat said item, and a second liquid which will not coat said item, said second liquid being perfluoro(methylcyclohexane) and being heavier than said first liquid and being immiscible with said first liquid, said moving being to where at least part of said item is positioned in said first liquid, then moving said item up through said first liquid to coat said item with said first liquid.

2. The process in claim 1 in which second liquid has a thickness through which said item is moved of about 5.5 times the thickness through which said item is moved of said first liquid.

* * * * *